US009204503B1

(12) United States Patent
Kost

(10) Patent No.: US 9,204,503 B1
(45) Date of Patent: Dec. 1, 2015

(54) SYSTEMS AND METHODS FOR DIMMING MULTIPLE LIGHTING DEVICES BY ALTERNATING TRANSFER FROM A MAGNETIC STORAGE ELEMENT

(71) Applicant: Cirrus Logic, Inc., Austin, TX (US)

(72) Inventor: Michael A. Kost, Austin, TX (US)

(73) Assignee: Philips International, B.V., Eindhoven (NL)

( * ) Notice: Subject to any disclaimer, the term of this patent is extended or adjusted under 35 U.S.C. 154(b) by 213 days.

(21) Appl. No.: 13/933,849

(22) Filed: Jul. 2, 2013

Related U.S. Application Data

(60) Provisional application No. 61/667,537, filed on Jul. 3, 2012.

(51) Int. Cl.
*H05B 37/02* (2006.01)
*H05B 37/00* (2006.01)
*H05B 33/08* (2006.01)

(52) U.S. Cl.
CPC ..... *H05B 33/0809* (2013.01)

(58) Field of Classification Search
CPC ..... H03B 33/0815; H03B 33/0827
USPC ..... 315/224, 244, 246, 247, 291, 307, 308, 315/312, 219, 185 R
See application file for complete search history.

(56) References Cited

U.S. PATENT DOCUMENTS 4,409,476 A 10/1983 Lofgren et al.
6,016,038 A 1/2000 Mueller et al.
6,150,774 A 11/2000 Mueller et al.
6,211,620 B1 4/2001 Gyoten et al.
6,211,626 B1 4/2001 Lys et al.
6,369,525 B1 4/2002 Chang et al.
6,441,558 B1 8/2002 Muthu et al.
6,495,964 B1 12/2002 Muthu et al.
6,583,550 B2 6/2003 Iwasa et al.

(Continued)

FOREIGN PATENT DOCUMENTS

EP 1528785 A1 4/2005
EP 1589519 A2 10/2005

(Continued)

OTHER PUBLICATIONS

Chromaticity Shifts in High-Power White LED Systems Due to Different Dimming Methods, 2 pages.

(Continued)

*Primary Examiner* — Dinh Le
(74) *Attorney, Agent, or Firm* — Jackson Walker L.L.P.

(57) ABSTRACT

In accordance with methods and systems of the present disclosure, an integrated circuit may include an output terminal and a switching circuit. The output terminal may supply charging current to a magnetic storage element for supplying energy to two or more lighting devices coupled to the magnetic storage element. The switching circuit may have an input coupled to an input power source and an output coupled to the output terminal for charging the magnetic storage element during charging intervals, wherein energy is supplied from the magnetic storage element to a first one of the lighting devices during flyback intervals following the charging intervals occurring during a first synchronization phase and to a second one of the lighting devices during flyback intervals following the charging intervals occurring during a second synchronization phase.

15 Claims, 6 Drawing Sheets

(56) References Cited

U.S. PATENT DOCUMENTS

| | | | | |
|---|---|---|---|---|
| 6,636,003 | B2 | 10/2003 | Rahm et al. | |
| 6,688,753 | B2 | 2/2004 | Calon et al. | |
| 6,753,661 | B2 | 6/2004 | Muthu et al. | |
| 6,756,772 | B2 | 6/2004 | McGinnis | |
| 6,788,011 | B2 | 9/2004 | Mueller et al. | |
| 6,888,322 | B2 | 5/2005 | Dowling et al. | |
| 6,958,920 | B2 | 10/2005 | Mednik et al. | |
| 6,967,448 | B2 | 11/2005 | Morgan et al. | |
| 6,975,079 | B2 | 12/2005 | Lys et al. | |
| 7,064,498 | B2 | 6/2006 | Dowling et al. | |
| 7,079,791 | B2 | 7/2006 | Chang | |
| 7,088,059 | B2 | 8/2006 | McKinney et al. | |
| 7,116,294 | B2 | 10/2006 | Stopa | |
| 7,135,824 | B2 | 11/2006 | Lys et al. | |
| 7,213,940 | B1 | 5/2007 | Van De Ven et al. | |
| 7,246,919 | B2 | 7/2007 | Porchia et al. | |
| 7,255,457 | B2 | 8/2007 | Ducharme et al. | |
| 7,288,902 | B1 | 10/2007 | Melanson | |
| 7,310,249 | B2 | 12/2007 | Yasumura | |
| 7,375,476 | B2 | 5/2008 | Walter et al. | |
| 7,498,753 | B2 | 3/2009 | McAvoy | |
| 7,511,437 | B2 | 3/2009 | Lys et al. | |
| 7,649,326 | B2 | 1/2010 | Johnson et al. | |
| 7,804,478 | B2 | 9/2010 | Schou | |
| 8,358,090 | B1 | 1/2013 | Mednik et al. | |
| 8,638,045 | B2 * | 1/2014 | Kunst et al. | 315/291 |
| 8,729,811 | B2 * | 5/2014 | Melanson | 315/219 |
| 8,779,686 | B2 * | 7/2014 | Jin | 315/294 |
| 2002/0019148 | A1 | 2/2002 | Hawryluk et al. | |
| 2002/0117972 | A1 | 8/2002 | Ito et al. | |
| 2002/0145041 | A1 | 10/2002 | Muthu et al. | |
| 2003/0057886 | A1 | 3/2003 | Lys et al. | |
| 2003/0085749 | A1 | 5/2003 | Xu et al. | |
| 2004/0057256 | A1 | 3/2004 | Feldkeller | |
| 2004/0085030 | A1 | 5/2004 | Laflamme et al. | |
| 2004/0105261 | A1 | 6/2004 | Ducharme et al. | |
| 2004/0169477 | A1 | 9/2004 | Yanai | |
| 2004/0212321 | A1 | 10/2004 | Lys et al. | |
| 2005/0062440 | A1 | 3/2005 | Lys et al. | |
| 2005/0218838 | A1 | 10/2005 | Lys | |
| 2005/0231459 | A1 | 10/2005 | Furukawa | |
| 2005/0243022 | A1 | 11/2005 | Negru | |
| 2005/0253533 | A1 | 11/2005 | Lys et al. | |
| 2006/0023002 | A1 | 2/2006 | Hara et al. | |
| 2006/0125420 | A1 | 6/2006 | Boone et al. | |
| 2006/0226795 | A1 | 10/2006 | Walter et al. | |
| 2006/0232219 | A1 | 10/2006 | Xu | |
| 2007/0024213 | A1 | 2/2007 | Shteynberg et al. | |
| 2007/0029946 | A1 | 2/2007 | Yu et al. | |
| 2007/0030241 | A1 | 2/2007 | Adachi et al. | |
| 2007/0114952 | A1 | 5/2007 | Yang | |
| 2007/0126656 | A1 | 6/2007 | Huang et al. | |
| 2007/0170876 | A1 | 7/2007 | Ito | |
| 2007/0195526 | A1 | 8/2007 | Dowling et al. | |
| 2007/0211013 | A1 | 9/2007 | Uehara et al. | |
| 2007/0262724 | A1 | 11/2007 | Mednik et al. | |
| 2008/0012502 | A1 | 1/2008 | Lys | |
| 2008/0018261 | A1 | 1/2008 | Kastner | |
| 2008/0054815 | A1 | 3/2008 | Kotikalapoodi et al. | |
| 2008/0116818 | A1 | 5/2008 | Shteynberg et al. | |
| 2008/0150433 | A1 | 6/2008 | Tsuchida et al. | |
| 2008/0224631 | A1 | 9/2008 | Melanson | |
| 2008/0224635 | A1 | 9/2008 | Hayes | |
| 2008/0232141 | A1 | 9/2008 | Artusi et al. | |
| 2009/0184616 | A1 | 7/2009 | Van De Ven et al. | |
| 2009/0218960 | A1 | 9/2009 | Lyons et al. | |
| 2009/0251925 | A1 | 10/2009 | Usui et al. | |
| 2010/0164403 | A1 | 7/2010 | Liu | |
| 2010/0283322 | A1 | 11/2010 | Wibben | |
| 2010/0295472 | A1 | 11/2010 | Wibben et al. | |
| 2011/0001440 | A1 | 1/2011 | Deurenberg et al. | |
| 2011/0210674 | A1 | 9/2011 | Melanson | |
| 2012/0025722 | A1 | 2/2012 | Mokry et al. | |
| 2012/0025733 | A1 | 2/2012 | Melanson | |
| 2012/0146519 | A1 | 6/2012 | Briggs | |
| 2012/0153834 | A1 | 6/2012 | Moss | |

FOREIGN PATENT DOCUMENTS

| | | | |
|---|---|---|---|
| EP | 2161969 | A2 | 3/2010 |
| WO | 02091805 | A2 | 11/2002 |
| WO | 2006067521 | A1 | 6/2006 |
| WO | 2007026170 | A2 | 3/2007 |
| WO | 2007093938 | A1 | 8/2007 |
| WO | 2008072160 | A1 | 6/2008 |
| WO | 2010016002 | A1 | 2/2010 |
| WO | 2011048214 | A1 | 4/2011 |
| WO | 2011061505 | A1 | 5/2011 |

OTHER PUBLICATIONS

Color Temperature, www.sizes.com, Mar. 27, 2007, 3 pages.

Linear Technology, Triple Output LED Driver Drives Up to 24 × 500mA LEDs & Offers 3,000:1 True Color PWM Dimming, News Release, May 24, 2007, 2 pages, Milpitas, CA.

Dilouie, Craig, Introducing the LED Driver, EC&M, pp. 28-32, Sep. 2004.

Light-emitting diode, http://er.wikipedia.org/wiki/Light-emitting_diode, printed Mar. 27, 2007, 16 pages.

Ohno, Yoshi, Spectral Design Considerations for White LED Color Rendering, Final manuscript, Optical Engineering, vol. 44, 111302 (2005), 20 pages.

* cited by examiner

SYSTEMS AND METHODS FOR DIMMING MULTIPLE LIGHTING DEVICES BY ALTERNATING TRANSFER FROM A MAGNETIC STORAGE ELEMENT

RELATED APPLICATIONS

The present disclosure claims priority to U.S. Provisional Patent Application Ser. No. 61/667,537, filed Jul. 3, 2012, which is incorporated by reference herein in its entirety.

FIELD OF DISCLOSURE

The present disclosure relates in general to lighting device power sources such as those included within dimmable light emitting diode lamps, and in particular to a lighting device that supplies and dims multiple lighting devices from a single transformer.

BACKGROUND

Lighting control and power supply integrated circuits (ICs) are in common use in both electronic systems and in replaceable consumer lighting devices, e.g., light-emitting-diode (LED) and compact fluorescent lamp (CFL) replacements for traditional incandescent light bulbs.

In particular, in dimmable replacement light bulbs, matching the hue/intensity profile of a traditional incandescent bulb as the lighting is typically not performed. Separate LED strings of different colors are needed in order to change the hue of the light, which raises cost. Further, each LED string typically requires a separate controllable power supply, adding additional cost, in particular when isolation is required.

Therefore, it would be desirable to provide a lower-cost power source circuit that can supply multiple strings of LEDs without requiring separate power supplies.

SUMMARY

In accordance with the teachings of the present disclosure, certain disadvantages and problems associated with dimming multiple lighting devices may be reduced or eliminated.

In accordance with embodiments of the present disclosure, a circuit for powering two or more lighting devices may include a first output terminal, a second output terminal, a first switching circuit, a magnetic storage element, and a second switching circuit. The first output terminal may provide a first output current or voltage to a first one of the lighting devices. The second output terminal may provide a second output current or voltage to a second one of the lighting devices. The first switching circuit may be coupled to an input power source. The magnetic storage element may have a primary winding coupled to the first switching circuit, wherein the first switching circuit charges the magnetic storage element from the input power source during charging intervals. The second switching circuit may be coupled to a second winding of the magnetic storage element for alternatively providing the first output current or voltage to the first output terminal during flyback intervals following the charging intervals occurring during a first synchronization phase and providing the second output current or voltage to the second output terminal during flyback intervals following the charging intervals occurring during a second synchronization phase.

In accordance with these and other embodiments of the present disclosure, a method of supplying power to two or more lighting devices may include controlling charging of a magnetic storage element during charging intervals. The method may also include controlling discharging of the magnetic storage element to alternate application of energy stored in the magnetic storage element between the multiple lighting devices during alternating synchronization phases during flyback intervals following the charging intervals. The method may further include providing a first output current or voltage to a first one of the lighting devices during flyback intervals occurring during a first one of the synchronization phases. The method may additionally include providing a second output current or voltage to a second one of the lighting devices during flyback intervals occurring during a second one of the synchronization phases.

In accordance with these and other embodiments of the present disclosure, an integrated circuit may include an output terminal and a switching circuit. The output terminal may supply charging current to a magnetic storage element for supplying energy to two or more lighting devices coupled to the magnetic storage element. The switching circuit may have an input coupled to an input power source and an output coupled to the output terminal for charging the magnetic storage element during charging intervals, wherein energy is supplied from the magnetic storage element to a first one of the lighting devices during flyback intervals following the charging intervals occurring during a first synchronization phase and to a second one of the lighting devices during flyback intervals following the charging intervals occurring during a second synchronization phase.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses circuits and methods for powering and controlling lighting devices. In particular embodiments, strings of light-emitting diodes (LEDs) are packaged to replace incandescent lamps, and the relative energy supplied to strings of different colors is varied as dimming is applied to the LED strings, so that a desired spectrum vs. intensity profile is achieved. The present disclosure discloses methods and systems for powering multiple lighting devices using a single magnetic storage device such as a transformer or inductor, and alternately charging the magnetic storage device with energy to be supplied to corresponding ones of the lighting devices, which may reduce cost and complexity of the power supply over a circuit in which separate magnetics are provided for each lighting device that is controlled.

Figure 1:
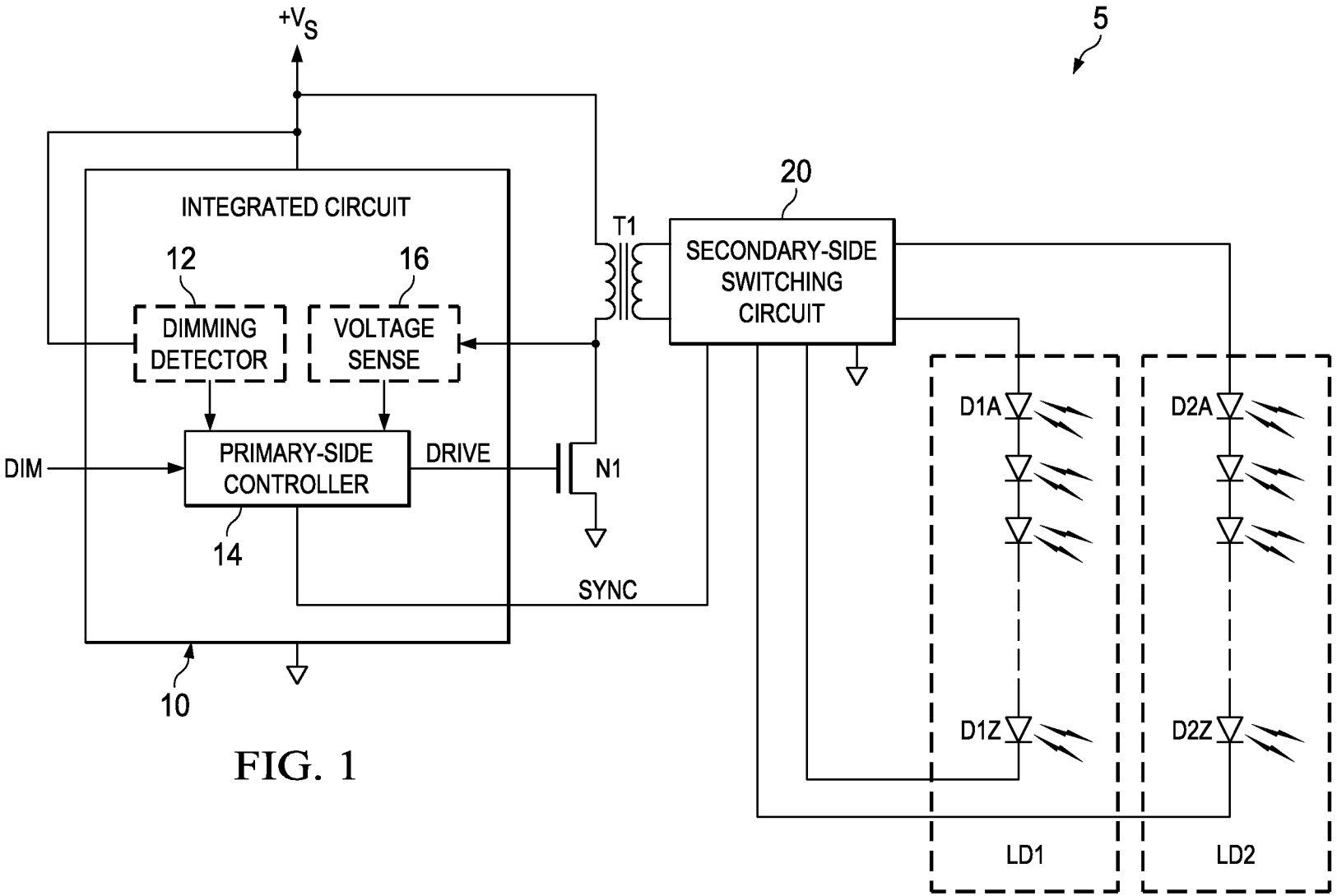
FIG. 1 illustrates a block diagram of an example lighting circuit, in accordance with embodiments of the present disclosure.

FIG. 1 illustrates a block diagram of an example lighting circuit 5, in accordance with embodiments of the present disclosure. A transformer T1 may provide a magnetic storage element through which energy is alternatively supplied to a first lighting device LD1 and a second lighting device LD2, respectively. Transformer T1 may further provide isolation between a primary side circuit coupled to a rectified line voltage source $+V_S$ and the lighting devices, which in the depicted embodiment are strings of series connected light-emitting diodes (LEDs) D1A-D1Z in lighting device LD1 and LEDs D2A-D2Z in lighting device LD2. While the example lighting devices are LEDs in FIG. 1, lighting devices LD1 and LD2 can alternatively be another type of lighting device, in accordance with other embodiments of the disclosure.

An integrated circuit (IC) 10 may provide a primary-side controller 14 that operates a switching transistor N1, which is illustrated as external to IC 10, but that alternatively may be included within IC 10. Primary-side controller 14 may be a pulse-width modulator, or other suitable controller capable of controlling the amount of energy applied to the primary winding of transformer T1, by the activation of switching transistor N1, according to dimming values DIM, which may be provided by a source internal or external to integrated circuit 10, and that may be optionally determined by a dimming detection circuit 12 that detects a dimming level of a dimmer controlling the line voltage from which power supply voltage $+V_S$ is derived. Lighting circuit 5 of FIG. 1 may also include a secondary-side switching circuit 20 that controls the alternating application of energy that was stored in transformer T1 during charging intervals when primary-side controller 14 activates switching transistor N1. Secondary-side switching circuit 20 may alternatively select application of output current or voltage between lighting devices LD1 and LD2 during corresponding flyback intervals. In the embodiments represented by FIG. 1, integrated circuit 10 and other elements on the primary side of transformer T1 may be non-isolated from secondary-side switching circuit 20, lighting devices LD1, LD2, and other elements on the secondary side of transformer T1, meaning that elements on each side of transformer T1 have a common ground. In other embodiments, such as but not limited to embodiments illustrated in FIG. 3, elements on the primary and secondary sides of transformer T1 may be isolated.

By controlling a level of energy storage in transformer T1 during the different charging intervals corresponding to lighting devices LD1 and LD2, the level of illumination intensity provided by lighting devices LD1 and LD2 may be controlled according to dimming values DIM. By using lighting devices LD1 and LD2 of different colors, a dimming profile matching that of an incandescent lamp, or another desired profile, can be obtained. In order to provide the proper energy levels in the proper cycles, sufficient synchronization should be maintained between primary-side controller 14 and secondary-side switching circuit 20. As illustrated in FIG. 1 and elsewhere in this disclosure, in accordance with various embodiments of the disclosure, the master synchronization source may be primary-side controller 14 and synchronization information SYNC may be transmitted/received through an isolated or non-isolated connection. In accordance with certain embodiments of the disclosure, a voltage sensing circuit 16 within integrated circuit 10 may detect conditions at the secondary winding of transformer T1 that indicate the cycle state of secondary-side switching circuit 20, eliminating the need for any extra components to provide the synchronization.

Figure 2:
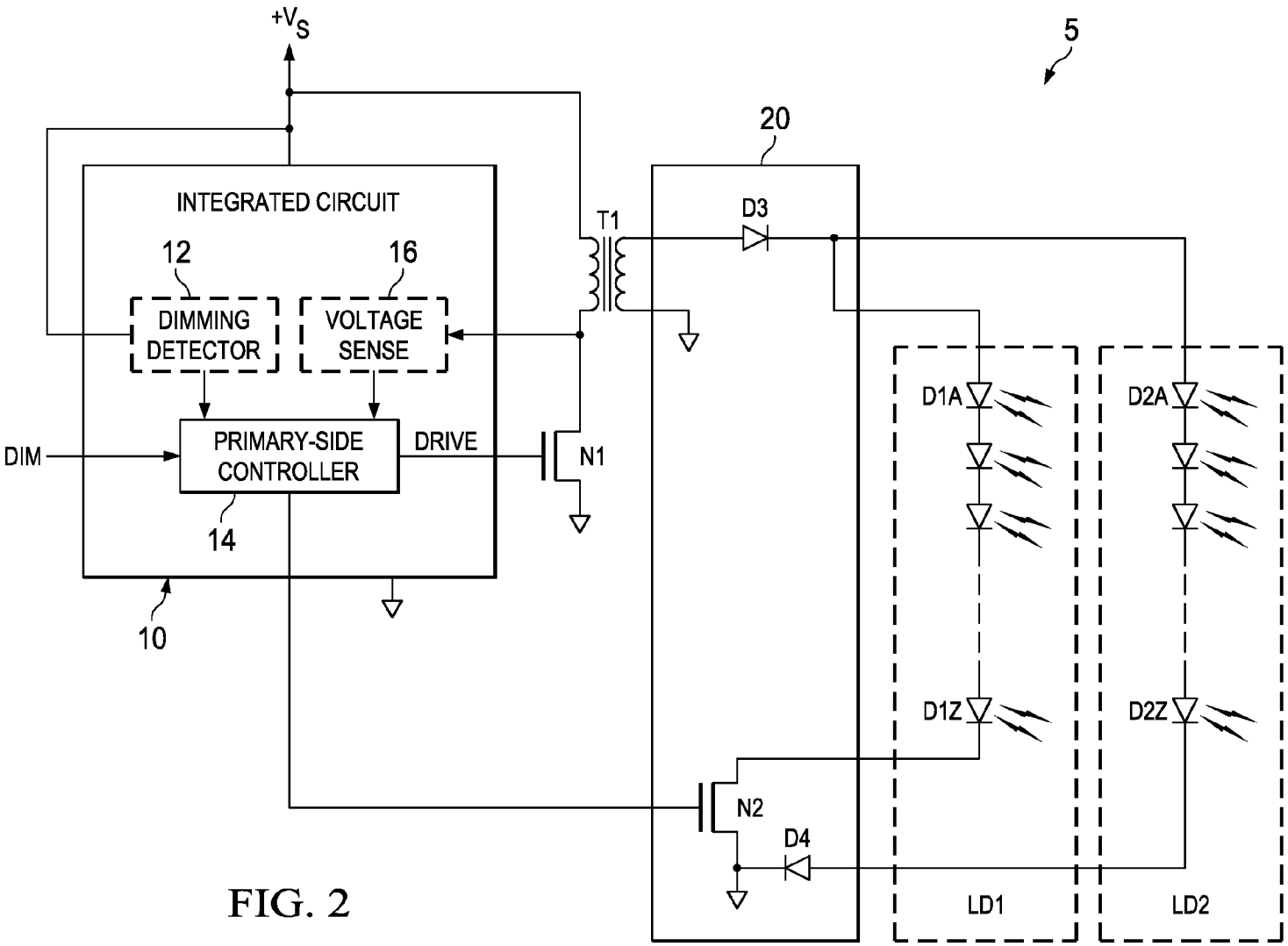
FIG. 2 illustrates a block diagram of the example lighting circuit shown in FIG. 1, with detail showing selected elements of an example secondary-side switching circuit, in accordance with embodiments of the present disclosure.

FIG. 2 illustrates a block diagram of example lighting circuit 5 shown in FIG. 1, with detail showing selected elements of example secondary-side switching circuit 20, in accordance with embodiments of the present disclosure. As shown in FIG. 2, secondary-side switching circuit 20 may include a blocking diode D3, a blocking diode D4, and a switching transistor N2. Diode D3 may prevent discharge of current from lighting devices LD1 and LD2 back into the secondary winding of transformer T1. Switching transistor N2 or other suitable switch may select application of current or voltage to either of lighting device LD1 and LD2 from the secondary winding of transformer T1, according to a synchronization signal SYNC provided by primary-side controller 14. When switching transistor N2 is active, voltage or current may flow through lighting device LD1, and when switching transistor N2 is inactive, voltage or current may flow through lighting device LD2 and blocking diode D4. Blocking diode D4 may prevent flow of current from ground to lighting device LD2. Although FIG. 2 depicts a particular implementation of secondary-side switching circuit 20, any suitable implementation providing identical or similar functionality to the particular implementation depicted may be used, such as, for example, secondary-side switching circuits with architectures similar to those described in any of: (i) U.S. patent application Ser. No. 13/173,526, filed Jun. 30, 2011 and entitled "Secondary-Side Alternating Energy Transfer Control with Inverted Reference and LED-Derived Power Supply"; (ii) U.S. patent application Ser. No. 12/894,440, filed Sep. 30, 2010 and entitled "Dimming Multiple Lighting Devices by Alternating Energy Transfer from a Magnetic Storage Element"; and (iii) U.S. patent application Ser. No. 12/675,035, filed Aug. 23, 2008 and entitled "Multi-LED Control" (collectively, the "Multi-LED Applications" each of which are incorporated by reference herein), and adapted in accordance with the present disclosure.

Figure 3:
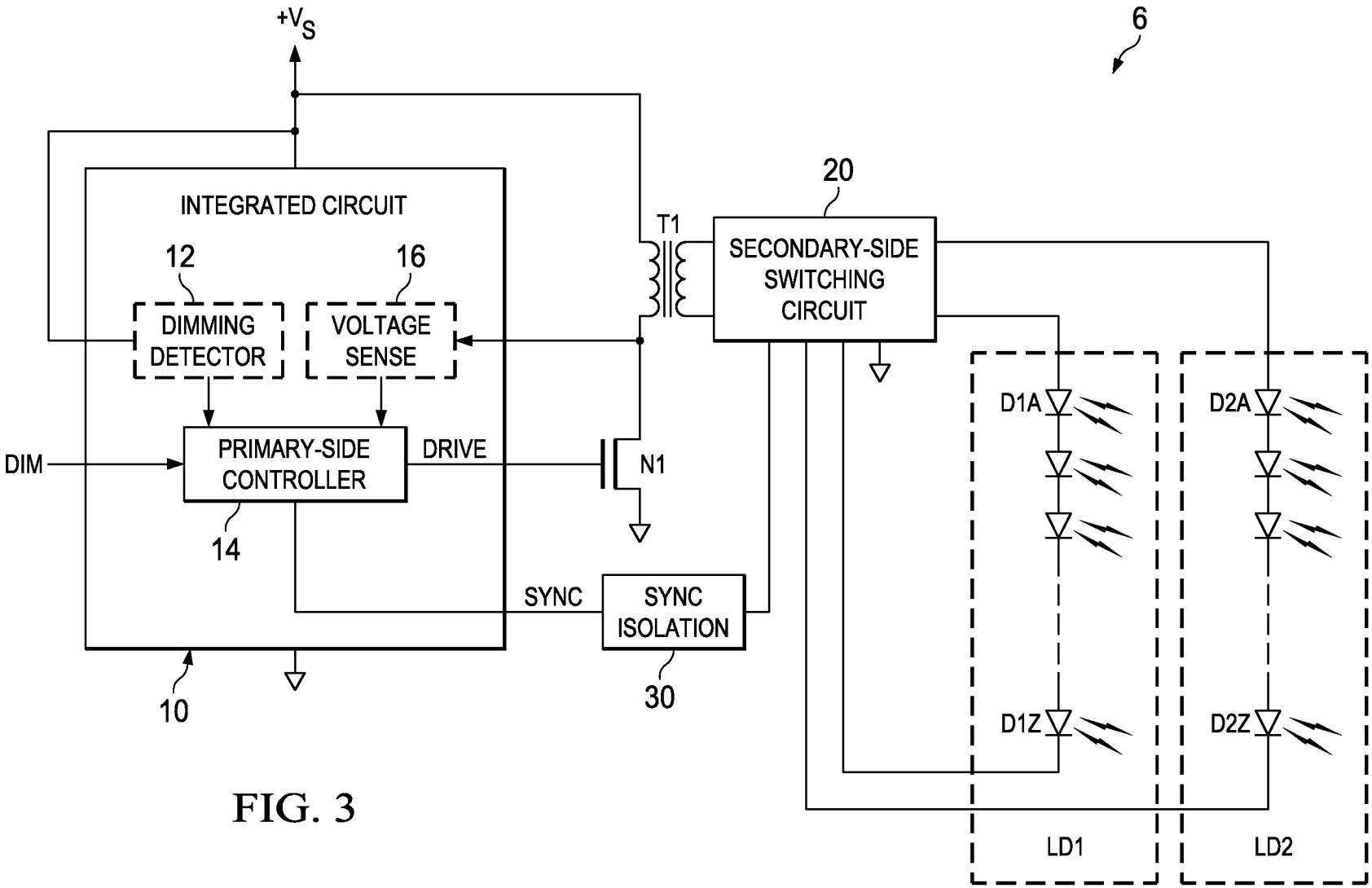
FIG. 3 illustrates a block diagram of another example lighting circuit, in accordance with embodiments of the present disclosure.

FIG. 3 illustrates a block diagram of another example lighting circuit 6, in accordance with embodiments of the present disclosure. Lighting circuit 6 is similar to lighting circuit 5 depicted in FIGS. 1 and 2, except that in the embodiments represented by FIG. 3, integrated circuit 10 and other elements on the primary side of transformer T1 may be isolated from secondary-side switching circuit 20, lighting devices LD1, LD2, and other elements on the secondary side of transformer T1, meaning that elements on each side of transformer T1 have a different ground. Accordingly, a sync isolation circuit 30 may be present in order to communicate synchronization signal SYNC from the primary side of T1 to the secondary side of T1. Each of FIGS. 4 and 5 illustrates a block diagram of example lighting circuit 6, with detail showing selected elements of an example sync isolation circuit 20 and with detail showing selected elements of example secondary-side switching circuit 20, in accordance with embodiments of the present disclosure.

Figure 4:
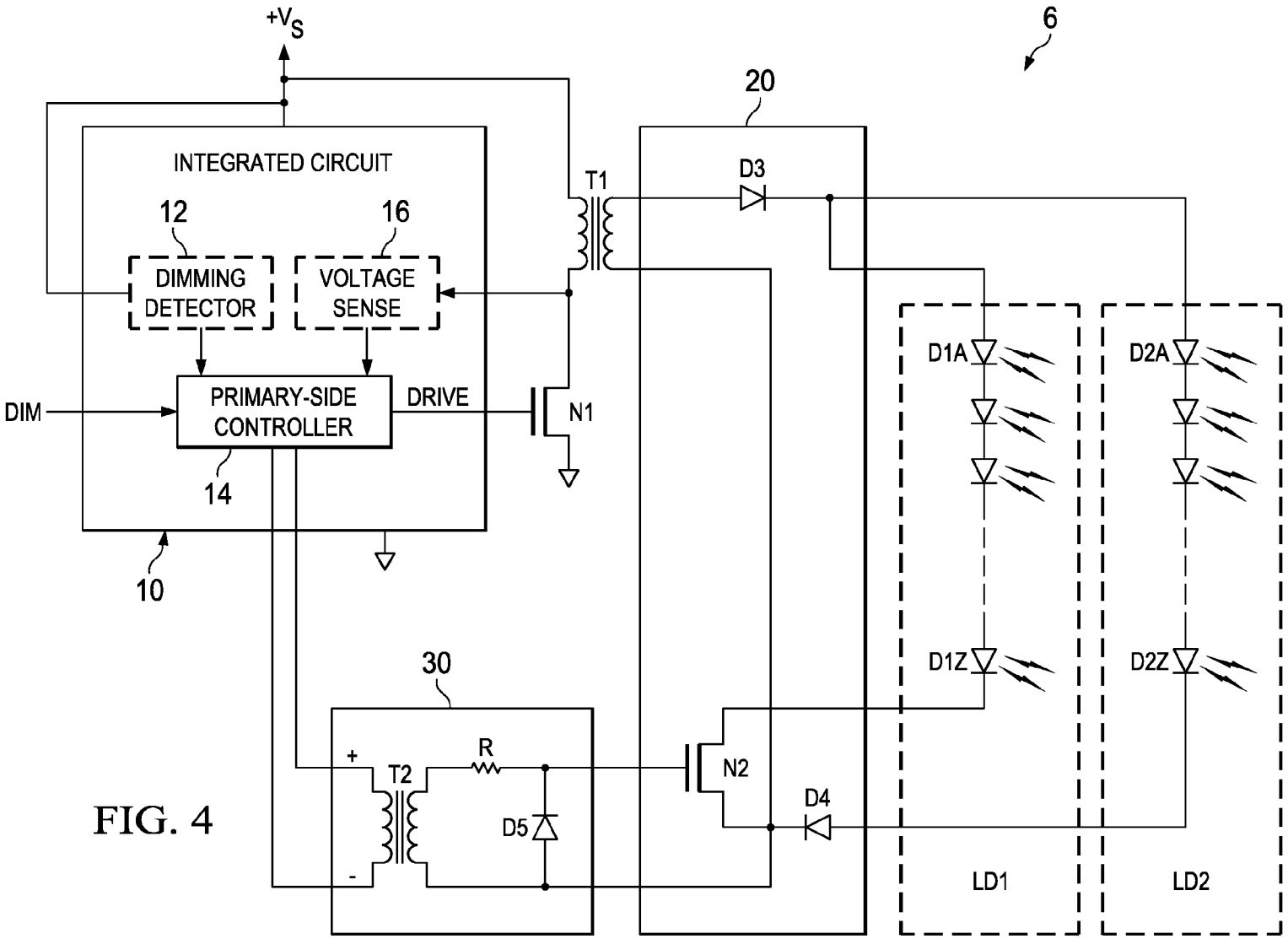
FIG. 4 illustrates a block diagram of the example lighting circuit shown in FIG. 3, with detail showing selected elements of an example sync isolation circuit, in accordance with embodiments of the present disclosure.
Figure 5:
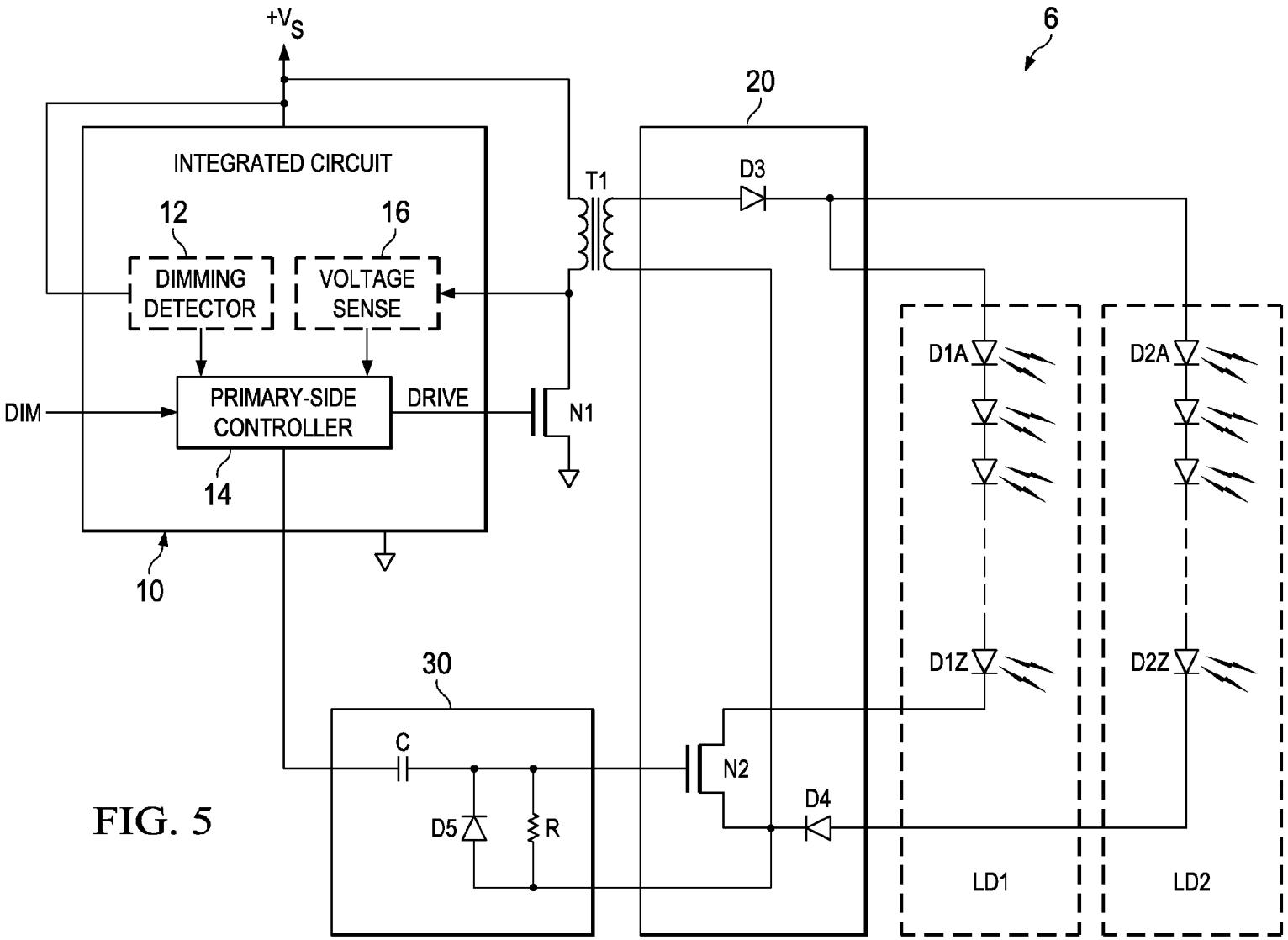
FIG. 5 illustrates a block diagram of the example lighting circuit shown in FIG. 3, with detail showing selected elements of another example sync isolation circuit, in accordance with embodiments of the present disclosure.

As shown in FIGS. 4 and 5, example secondary-side switching circuit 20 of lighting system 6 may be similar or identical to secondary-side switching circuit 20 of lighting system 5. Although FIGS. 4 and 5 depict particular implementations of secondary-side switching circuit 20, any suitable implementation providing identical or similar functionality to the particular implementation depicted may be used, such as, for example, secondary-side switching circuits with architectures similar to those described in any of Multi-LED Applications, and adapted in accordance with the present disclosure.

As shown in FIG. 4, sync isolation circuit 30 may comprise a transformer T2, a resistor R, and a diode D5. To turn on switching transistor N2, a positive voltage is applied across the primary winding terminals of transformer T2 by primary-side controller 14. Such positive voltage may be applied by setting the positive polarity terminal of transformer T2 (denoted by "+" in FIG. 4) at a voltage potential higher than the negative polarity terminal of transformer T2 (denoted by "–" in FIG. 4). Transformer T2 may present a voltage to its secondary winding, and thus the gate terminal of transformer T2, based on the primary winding voltage and the transformer turns ratio of transformer T2. To disable the switching transistor N2, primary-side controller 14 may apply a greater voltage potential to the negative polarity terminal of transformer T2 than the positive polarity terminal of transformer T2. Diode D5 may prevent the gate voltage of N2 from decreasing appreciably below the source voltage.

Alternatively, as shown in FIG. 5, sync isolation circuit 30 may comprise a capacitor C, a resistor R, and a diode D5. To turn on switching transistor N2, a low-to-high voltage transition may be applied to capacitor C, resulting in a positive charge transferring to the gate terminal of switching transistor N2, thus turning it on. Conversely, to disable switching transistor N2, a high-to-low voltage transition may be applied to capacitor C. Diode D5 may prevent the gate voltage of N2 from decreasing appreciably below the source voltage.

Figure 6:
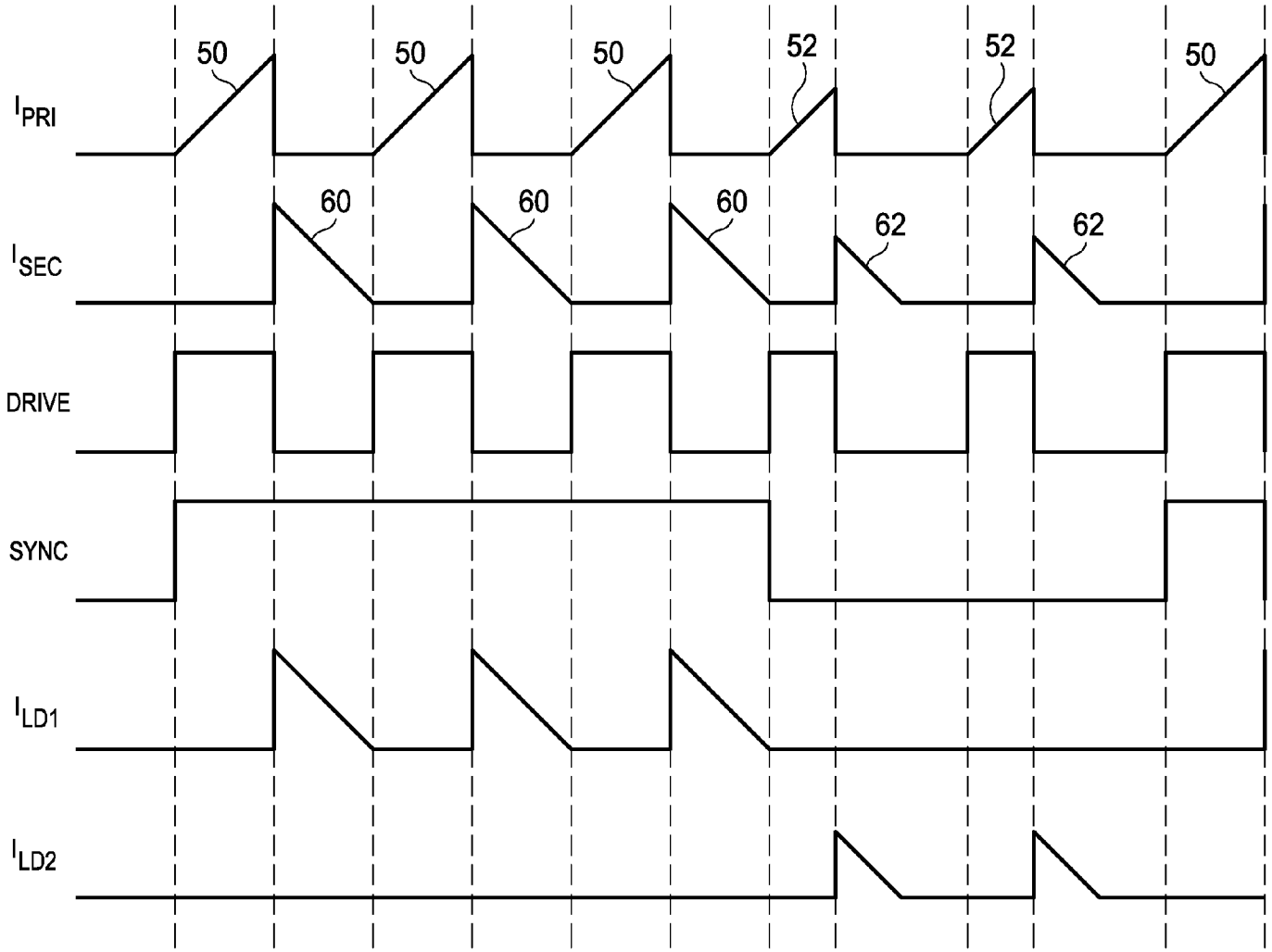
FIG. 6 illustrates example timing diagrams of selected signals within the lighting circuits of FIGS. 1-5, in accordance with embodiments of the present disclosure.

FIG. 6 illustrates example timing diagrams of selected signals within the lighting circuits of FIGS. 1-5, in accordance with embodiments of the present disclosure. During a first synchronization phase in which synchronization signal SYNC is active, one or more charging intervals 50 may store energy in transformer T1 as determined by a peak of the primary winding current $I_{PRI}$ during each charging interval 50 (e.g., the value of $I_{PRI}$ at time $t_1$). The rising value of primary winding current $I_{PRI}$ during each of the one or more charging intervals 50 may be caused by activation of switching transistor N1 according to gate drive signal DRIVE. Because synchronization signal SYNC is active during the first synchronization phase, switching transistor N2 is active during the first synchronization phase. Thus, during flyback intervals 60 following charging intervals 50 occurring during the first synchronization phase, flyback secondary current $I_{SEC}$ from the secondary winding of transformer T1 may be applied to lighting device LD1 as shown by current waveform $I_{LD1}$ in FIG. 6.

Similarly, during a second synchronization phase, synchronization signal SYNC is inactive, one or more charging intervals 52 may store energy in transformer T1 as determined by a peak of the primary winding current $I_{PRI}$ during each charging interval 52 (e.g., the value of $I_{PRI}$ at time $t_1$). As in the first synchronization phase, the rising value of primary winding current $I_{PRI}$ during each of the one or more charging intervals 52 may be caused by activation of switching transistor N1 according to gate drive signal DRIVE. Because synchronization signal SYNC is inactive during the second synchronization phase, switching transistor N2 is inactive during the second synchronization phase. Thus, during flyback intervals 62 following charging intervals 52 occurring during the second synchronization phase, flyback secondary current $I_{SEC}$ from the secondary winding of transformer T1 may be applied to lighting device LD2 as shown by current waveform $I_{LD2}$ in FIG. 6.

The various waveforms in FIG. 6 may be repeated to continuously and alternatively provide energy to lighting devices LD1 and LD2, although the pulse widths of the DRIVE and SYNC signals may be varied (e.g., based on a dimmer signal Dim) in order to control the respective intensities of lighting devices LD1 and LD2. For example, by controlling the value of the primary winding current $I_{PRI}$ during the first charging intervals 50 (based on the active pulse width of the gate drive signal DRIVE) and the length of the synchronization phase (based on the active pulse width of the synchronization signal SYNC) the intensity of lighting device LD1 may be controlled, while controlling the value of the primary winding current $I_{PRI}$ during the second charging intervals 52 (based on the active pulse width of the gate drive signal DRIVE) and the length of the synchronization phase (based on the inactive pulse width of the synchronization signal SYNC) the intensity of lighting device LD2 may be controlled.

The timing of the various signals shown in FIG. 6 are merely illustrative, and the timing of the various signals may vary (e.g., based on a dimmer setting Dim) to achieve a desired intensity profile for each of LD1 and LD2.

Any suitable method may be used to control the waveforms for DRIVE and SYNC to achieve desired intensity profiles for LD1 and LD2. For example, in some embodiments, the number of active DRIVE pulses within each synchronization phase may be a function of dimming signal Dim, in which case a method for determining the number of active DRIVE pulses within each synchronization phase may be shown in C-style pseudocode as:

```
while(1) {
  for (I = 0, I < LD1_DRIVE_pulses(Dim); I++)
    pulseLD1( ); //SYNC active
  for (I = 0, I <LD2_DRIVE_pulses(Dim); I++)
    pulseLD2( ); //SYNC inactive
  }
```

As another example, in some embodiments, the number of active DRIVE pulses within each synchronization phase may be a function of dimming signal Dim, and delta-sigma modulation may be used to achieve a fractional average of the number of DRIVE pulses in each of the synchronization phases, and may be shown in C-style pseudocode as:

```
while(1) {
  if (integrator > 0) {
    pulseLD1( ); //SYNC active
    integrator += LD1_DRIVE_pulse(Dim)
    }
  else {
    pulseLD2( ); //SYNC inactive
    integrator -= LD2_DRIVE_pulse(Dim)
    }
  }
```

Although FIGS. 1-6 contemplate the use of two lighting devices LD1 and LD2, those of ordinary skill in the art will recognize that the methods and systems described herein may be adapted for use with any number of lighting devices. Accordingly, FIGS. 1-6 may, in some embodiments, further include at least one additional output terminal of secondary-side switching circuit 20 for providing at least one additional output current or voltage to at least one additional corresponding lighting device, wherein the secondary-side switching circuit alternatively couples the secondary winding of transformer T1 to a first output terminal to provide a first current or voltage to lightning device LD1, a second output terminal to provide a second current or voltage to lightning device LD2, and the at least one additional output terminal to provide at least one additional current or voltage to at least one additional lightning device, during the first synchronization phase, the second synchronization phase, and at least one additional synchronization phase, respectively.

As used herein, when two or more elements are referred to as "coupled" to one another, such term indicates that such two or more elements are in electronic communication whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A circuit for powering two or more lighting devices, the circuit comprising:

a first output terminal for providing a first output current or voltage to a first one of the lighting devices;

a second output terminal for providing a second output current or voltage to a second one of the lighting devices;

a first switching circuit coupled to an input power source;

a magnetic storage element having a primary winding coupled to the first switching circuit, wherein the first switching circuit charges the magnetic storage element from the input power source during charging intervals;

a second switching circuit coupled to a second winding of the magnetic storage element for alternatively providing the first output current or voltage to the first output terminal during flyback intervals following the charging intervals occurring during a first synchronization phase and providing the second output current or voltage to the second output terminal during flyback intervals following the charging intervals occurring during a second synchronization phase; and a primary-side control circuit coupled to the first switching circuit and the second switching circuit for controlling durations of each of the first synchronization phase and the second synchronization phase.

2. The circuit of claim 1, wherein a duration of the first synchronization phase and a duration of the second synchronization phase are based at least on a dimming level setting of a dimmer coupled to the circuit.

3. The circuit of claim 1, wherein the control circuit controls the first switching circuit to control charging of the magnetic storage element to different energy storage levels during each of the first synchronization phase and the second synchronization phase whereby different amounts of energy are transferred to individual lighting devices of the two or more lighting devices.

4. The circuit of claim 1, wherein the two or more lighting devices are two or more light-emitting diode circuits each having one or more light-emitting diodes connected in series.

5. The circuit of claim 1, wherein the first output current or voltage and the second output current or voltage are based at least on a dimming level setting of a dimmer coupled to the circuit.

6. A method of supplying power to two or more lighting devices, the method comprising:

controlling charging of a magnetic storage element during charging intervals with a first switching circuit coupled to a primary winding of the magnetic storage element;

controlling, with a second switching circuit coupled to a secondary winding of the magnetic storage element, discharging of the magnetic storage element to alternate application of energy stored in the magnetic storage element between the multiple lighting devices during alternating synchronization phases during flyback intervals following the charging intervals;

providing a first output current or voltage to a first one of the lighting devices during flyback intervals occurring during a first one of the synchronization phases;

providing a second output current or voltage to a second one of the lighting devices during flyback intervals occurring during a second one of the synchronization phases; and controlling, with a primary-side control circuit coupled to the first switching circuit and the second switching circuit, durations of each of the first synchronization phase and the second synchronization phase.

7. The method of claim 6, wherein a duration of the first synchronization phase and a duration of the second synchronization phase are based at least on a dimming level setting of a dimmer coupled to a circuit comprising the magnetic storage element.

8. The method of claim 6, further comprising charging of the magnetic storage element to different energy storage levels during each of the first synchronization phase and the second synchronization phase whereby different amounts of energy are transferred to individual lighting devices of the two or more lighting devices.

9. The method of claim 6, wherein the two or more lighting devices are two or more light-emitting diode circuits each having one or more light-emitting diodes connected in series.

10. The method of claim 6, wherein the first output current or voltage and the second output current or voltage are based at least on a dimming level setting of a dimmer coupled to a circuit comprising the magnetic storage element.

11. An integrated circuit, comprising:

an output terminal coupled to a primary winding of a magnetic storage element for supplying charging current to the magnetic storage element, wherein the magnetic storage element is for supplying energy to two or more lighting devices coupled to a secondary winding of the magnetic storage element;

a switching circuit having an input coupled to an input power source and an output coupled to the output terminal for charging the magnetic storage element during charging intervals, wherein energy is supplied from the magnetic storage element to a first one of the lighting devices during flyback intervals following the charging intervals occurring during a first synchronization phase and to a second one of the lighting devices during flyback intervals following the charging intervals occurring during a second synchronization phase; and a primary-side control circuit coupled to the switching circuit for controlling durations of each of the first synchronization phase and the second synchronization phase.

12. The integrated circuit of claim 11, wherein a duration of the first synchronization phase and a duration of the second synchronization phase are based at least on a dimming level setting of a dimmer coupled to the integrated circuit.

13. The integrated circuit of claim 11, wherein the control circuit controls the first switching circuit to control charging of the magnetic storage element to different energy storage levels during each of the first synchronization phase and the second synchronization phase whereby different amounts of energy are transferred to individual lighting devices of the two or more lighting devices.

14. The integrated circuit of claim 11, wherein the two or more lighting devices are two or more light-emitting diode circuits each having one or more light-emitting diodes connected in series.

15. The integrated circuit of claim 11, wherein a first energy supplied to the first one of the lighting devices during the first synchronization phase and a second energy supplied to the second one of the lighting devices during the second synchronization phase are based at least on a dimming level setting of a dimmer coupled to the integrated circuit.

* * * * *